US006875161B1

(12) United States Patent
Brice

(10) Patent No.: US 6,875,161 B1
(45) Date of Patent: Apr. 5, 2005

(54) WEIGHT LIFTING DEVICE

(76) Inventor: John P. Brice, 14962 Bear Valley Rd., Victorville, CA (US) 92302

( * ) Notice: Subject to any disclaimer, the term of this patent is extended or adjusted under 35 U.S.C. 154(b) by 475 days.

(21) Appl. No.: 10/126,336

(22) Filed: Apr. 19, 2002

(51) Int. Cl.[7] ..... A63B 21/072

(52) U.S. Cl. ..... 482/107; 482/98

(58) Field of Search ..... 482/106–109, 482/98

(56) References Cited

U.S. PATENT DOCUMENTS

| | | | | |
|---|---|---|---|---|
| 1,672,944 | A * | 6/1928 | Jowett | 482/108 |
| 1,991,520 | A * | 2/1935 | Postl | 482/108 |
| 3,488,051 | A * | 1/1970 | Papsitas-Scherer | 482/108 |
| 4,529,197 | A * | 7/1985 | Gogarty | 482/107 |
| 4,638,994 | A * | 1/1987 | Gogarty | 482/107 |
| 4,722,523 | A * | 2/1988 | Yang | 482/108 |
| 5,222,930 | A * | 6/1993 | Bold, Jr. | 482/132 |
| 5,421,797 | A * | 6/1995 | Fletcher | 482/106 |
| 5,484,367 | A * | 1/1996 | Martinez | 482/107 |
| 5,628,716 | A * | 5/1997 | Brice | 482/106 |
| 6,406,409 | B1 * | 6/2002 | Silver | 482/104 |
| 2003/0232705 | A1 * | 12/2003 | Harms et al. | 482/108 |
| 2004/0072662 | A1 * | 4/2004 | Landfair | 482/106 |

FOREIGN PATENT DOCUMENTS

| | | | |
|---|---|---|---|
| GB | 2135894 A | * | 9/1984 |

* cited by examiner

*Primary Examiner*—Justine R. Yu
*Assistant Examiner*—Victor K. Hwang
(74) *Attorney, Agent, or Firm*—Coats & Bennett, P.L.L.C.

(57) ABSTRACT

A weight lifting system including a handle or bar that is adapted to be connected to a weight plate. The weight plate includes a central opening that extends through the weight plate. One end portion of the handle is inserted into one end of the opening within the weight plate. A bolt is extended into the opening of the weight plate, from the opposite side, and threaded into a threaded bore formed axially within the end portion. A shoulder is formed intermediately within the opening of the weight plate. As the bolt is turned and threaded into the threaded bore, the end portion of the handle is drawn towards the shoulder while a head portion of the bolt moves towards the shoulder. By securely tightening the bolt within the threaded bore, the bolt head is brought into contact with the shoulder and thereby the inward movement of the bolt is limited. The opening in the weight plate and the bolt are sized such that when the bolt is securely tightened within the threaded bore of the end portion of the handle, the head of the bolt will be recessed within the opening of the weight plate and will not protrude past the adjacent side of the weight plate. To conceal the bolt head and the bolt, a cap can be secured to the end of the opening adjacent the bolt head.

28 Claims, 4 Drawing Sheets

WEIGHT LIFTING DEVICE

FIELD OF THE INVENTION

The present invention relates to barbells, dumbbells and weight lifting devices in general, and more particular to a method and apparatus for securing a weight plate to a barbell, dumbbell or handle of a weight lifting device.

BACKGROUND OF THE INVENTION

The basic design of barbells and dumbbells and other free weight weightlifting devices are well known and appreciated. Typically, a handle or bar is inserted through a central opening within one or more weight plates. An inside collar is usually secured or fixed to the handle or bar inboard the one or more weight plates on each end of the bar or handle. About the outboard side of the one or more weights, there is usually provided another collar that is secured to the handle or bar. Thus, about each end of the handle or bar there is secured one or more weight plates between two spaced apart collars.

Safety is of paramount concern in securing weight plates to a handle or bar. It is, of course, important to retain the weight plates on the bar or handle, and it is also desirable that the weight plates not be able to freely rotate or turn on the handle or the bar. Simply put, weight plates can be extremely heavy and if they inadvertently fall from a bar or handle, it is certainly possible that an injury may result.

In addition, the securing mechanisms traditionally used to secure weight plates to handles and bars do very little to enhance the overall appearance of such weight lifting devices. This is because the securing mechanisms typically lie outside of the weight plates themselves, and, as pointed out above, sometimes these securing mechanisms are separate components from the weight plate and the supporting handle or bar. In the end, securing mechanisms of the prior art are not always totally reliable and even the more reliable ones do very little to enhance the overall appearance and design of the weight lifting device.

Therefore, there has been and continues to be a need for a weight lifting device such as a barbell or a dumbbell, that is designed such that the weight plates are securely held on the handle or bar and that the actual securing mechanism is inconspicuous as practically possible in order to yield a reliable and aesthetic pleasing product.

SUMMARY OF THE INVENTION

The present invention entails a weight lifting device that includes a securing mechanism for securely connecting one or more weight plates to a handle or bar in such a manner that the weight plate is securely held on the handle or bar and the securing mechanism is practically hidden from view. In one embodiment of the present invention, an end portion of the handle or bar is inserted into one end of a central opening formed in the weight plate. To secure the end portion of the handle or bar within one end of the opening within the weight plate, a bolt is extended from the other side into the opening and threaded into an axial threaded bore formed in the end portion of a handle or bar. The bolt is securely tightened within the threaded bore and in the process is drawn to a recessed position within the weight plate.

In one particular embodiment of the present invention, the end portion of the handle is formed in a polygonal shape, such as a square or rectangular shape. Likewise a portion of the opening in the weight plate is shaped accordingly to enable the end portion of the handle to be inserted therein. This will prevent the weight plate from rotating on the handle.

In another particular embodiment of the present invention, the opening formed through the weight plate includes three areas. It includes a receiving area for receiving the end portion of the handle. A second area is referred to as a recessed area since it receives the bolt head and effectively enables the bolt head to be recessed within the weight plate. A third area is referred to as a shoulder. The shoulder partially divides the receiving area from the recessed area. When the bolt is securely tightened within the threaded bore in the end portion of the handle, the bolt head will engage and abut against the shoulder, thereby limiting the inward movement of the bolt head and at the same time pulling the end portion of the handle snugly against the shoulder. Optionally, an end cap can be provided to fit over the recessed bolt head when the weight plate has been secured to the handle or bar.

Other objects and advantages of the present invention will become apparent and obvious from a study of the following description and the accompanying drawings which are merely illustrative of such invention.

DESCRIPTION OF AN EXEMPLARY EMBODIMENT

Figure 1:
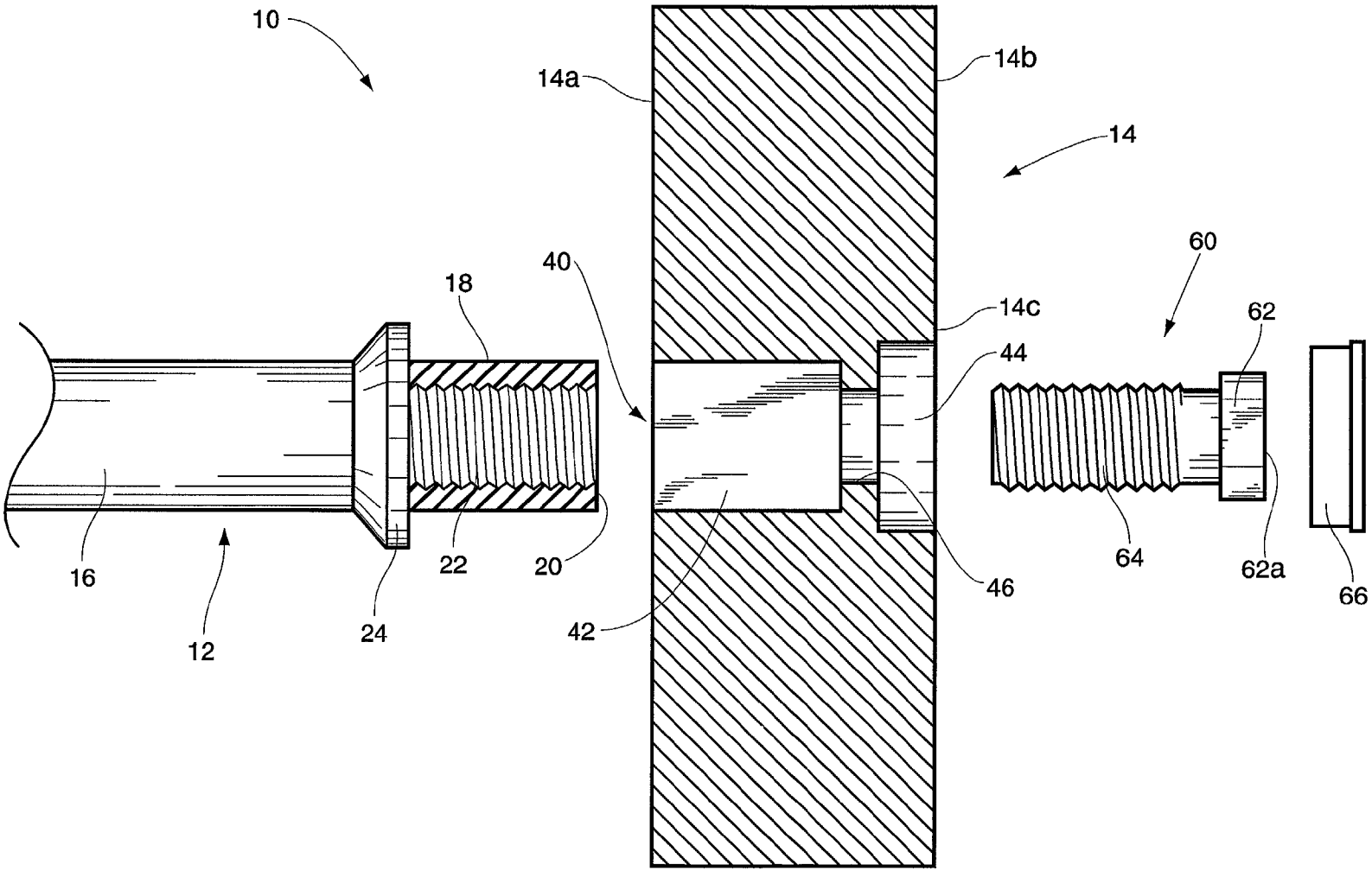
FIG. 1 is an exploded view of one end portion of the weight lifting device of the present invention wherein portions thereof are shown in section.
Figure 1A:
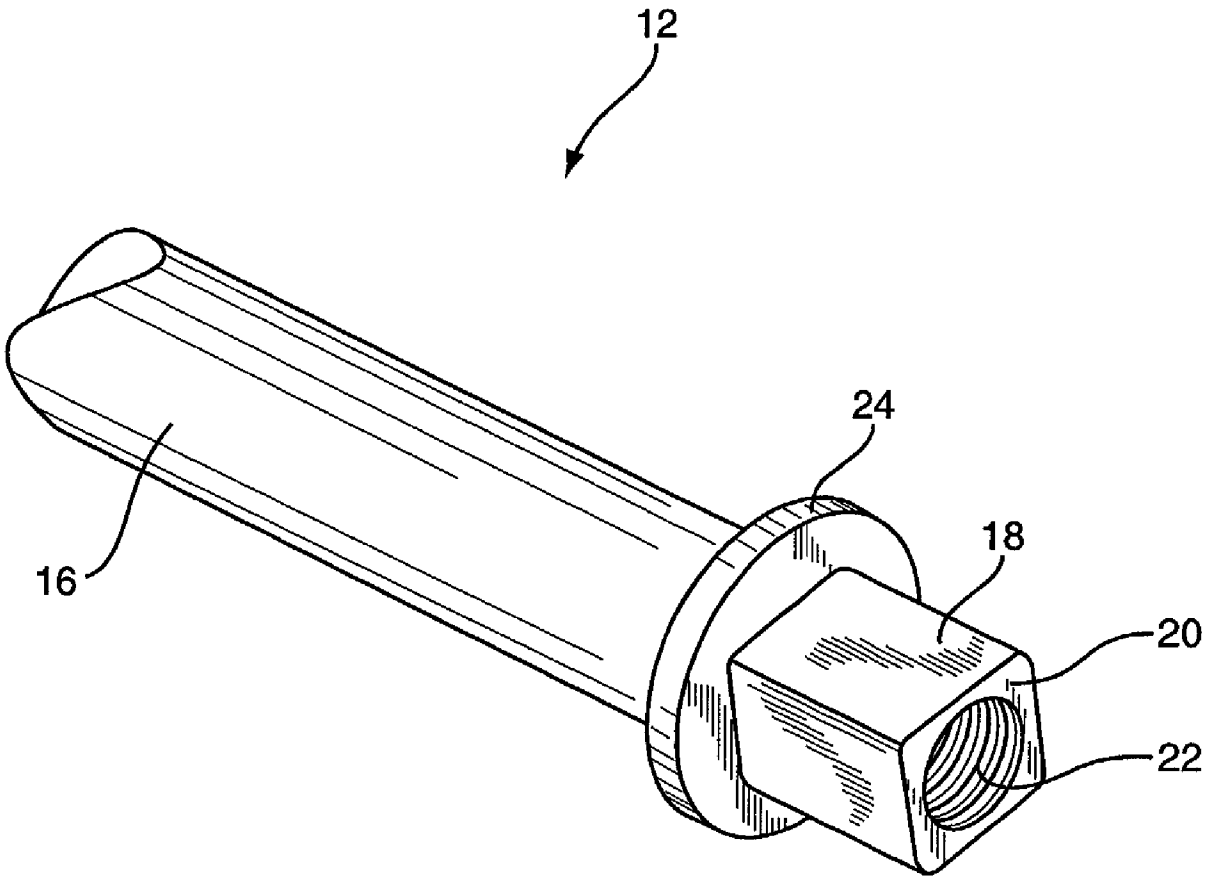
FIG. 1A is a perspective view of a portion of the handle of the weight lifting device.

With reference to the drawings, the weight lifting device of the present invention is shown therein and indicated generally by the numeral 10. Weight lifting device 10 includes a handle indicated generally by the numeral 12. In some cases, the handle 12 is referred to as a bar. Further, the weight lifting device 10 is adapted to receive and support a number of weight plates. Each weight plate is indicated generally by the numeral 14.

First, discussing the handle 12, the handle includes a central portion 16 that extends between a pair of inside collars 24. Collars 24 are formed on the handle and remain fixed. The collars 24 can assume various shapes. For example, the collars 24 can match the weight plate and could include 14 sides or simply be round. Disposed about each end of the handle 12 is a pair of end portions indicated by the numeral 18. Each end portion 18 in the case of this embodiment, extends from the adjacent inside collar 24 outwardly. Each end portion 18 includes a terminal end 20.

Axially formed in the end portion 18 is a threaded bore 22. As will be appreciated from subsequent portions of the disclosure, the threaded bore 22 functions to receive a threaded bolt that is utilized to secure a weight plate 14 onto an end portion 18 of the handle 16.

In the case of one embodiment of the present invention, the end portion 18 is of a particular shape. In this case, the end portion assumes a polygonal shape, meaning in this case that the end portion includes two or more flat sides. In particular, it is contemplated that the end portion 18 would be of a square or rectangular cross section. Alternatively, the end portion may be round or include one or more flat sides.

Turning to a discussion of the weight plate 14, it is seen that the same includes a central opening, indicated generally by the numeral 40. Central opening 40, in the case of the embodiment illustrated herein, is of a multi-sectional configuration. That is, the central opening 40 includes a series of discreet areas with the respective areas performing certain functions in securing the weight plate 14 to the handle 12. The weight plate may be coated in rubber or plated in chrome or other suitable coatings.

For purposes of reference, the weight plate is said to have an inner side 14*a* and an outer side 14*b*. The central opening 40, discussed above, includes a receiving area indicated by the numeral 42. Receiving area 42 functions to receive and hold the end portion 18 of the handle. Note that the receiving area 42 begins at the inner side 14*a* of the weight plate 14 and extends outwardly therefrom. Receiving area 42 will preferably be configured to match and correspond to the shape of the end portion 18 of the handle. It will, of course, be slightly larger in cross sectional area such that the end portion 18 can be inserted and fitted snugly therein. Accordingly, if the end portion 18 is of a square or rectangular cross section, it follows that the receiving area 42 would also be of a like rectangular or square cross sectional area.

Formed on the other side of the opening 40, adjacent the outer side 14*b* of the weight plate 14, is an area that is referred to as the recessed area 44. It is referred to as the recessed area because, as will be appreciate from subsequent portions of the disclosure, this area functions to receive a bolt head that forms a part of the bolt that is used to secure the weight plate 14 to the end portion 18 of the handle 12. In fact, the bolt head, when the weight plate 14 is secured to the end portion 18, is recessed into the recessed area 44.

Disposed generally between the receiving area 42 and the recessed area 44 is a shoulder 46. Note in FIGS. 1 and 2 where the shoulder tends to separate the receiving area 42 from the recessed area 44. Also, note that the opening 40 is continuous from the inner side 14*a* of the weight plate 14 to the outer side 14*b* of the weight plate, and that the opening 40 does extend through to form shoulder 46.

As noted above, a bolt, indicated generally by the numeral 60, is utilized to secure the weight plate 14 to an end portion 18 of the handle. Bolt 60 includes a head 62 and a shank 64. Shank 64 is at least partially threaded and the bolt 60 is designed such that the threaded portion of the shank 64 can be screwed and secured into the threaded bore 22 formed in the end portion 18 of the handle 12.

In securing a weight plate 14 to an end portion 18 of the handle 12, the end portion 18 is inserted into the receiving area 42 of the central opening 40. Note that the inside collar 24 disposed inwardly of the end portion 18 will effectively limit the distance that the end portion 18 can extend into the central opening 40. Likewise, the shoulder 46 will prevent the terminal end 20 from passing outwardly thereof.

In any event, once the end portion 18 has been inserted into the receiving area 42, the bolt 60 is inserted into the opening 40 from the outer side 14*b* of the weight plate 14. The bolt 60 is properly aligned such that the shank 64 extends inwardly of the shoulder 46 and by threading the threaded portion of the shank 64 into the threaded bore 22, it is appreciated that the bolt acts to secure the weight plate 14 to the end portion 18. Essentially, the bolt head 62 is screwed down into engagement with the shoulder 46. In this process, the end portion 18 is pulled towards the shoulder 46 and depending upon the tolerances, can be pulled into engagement with the shoulder 46, thereby securing the weight plate 14 to the end portion 18 of the handle 12.

Although not shown herein, a lock washer can be utilized as a safety precaution. In this case, a lock washer can be extended over the shank 64 and when the bolt 60 is secured within the threaded bore 22, the lock washer would be disposed between the shoulder 46 and the bolt head 62.

Figure 2:
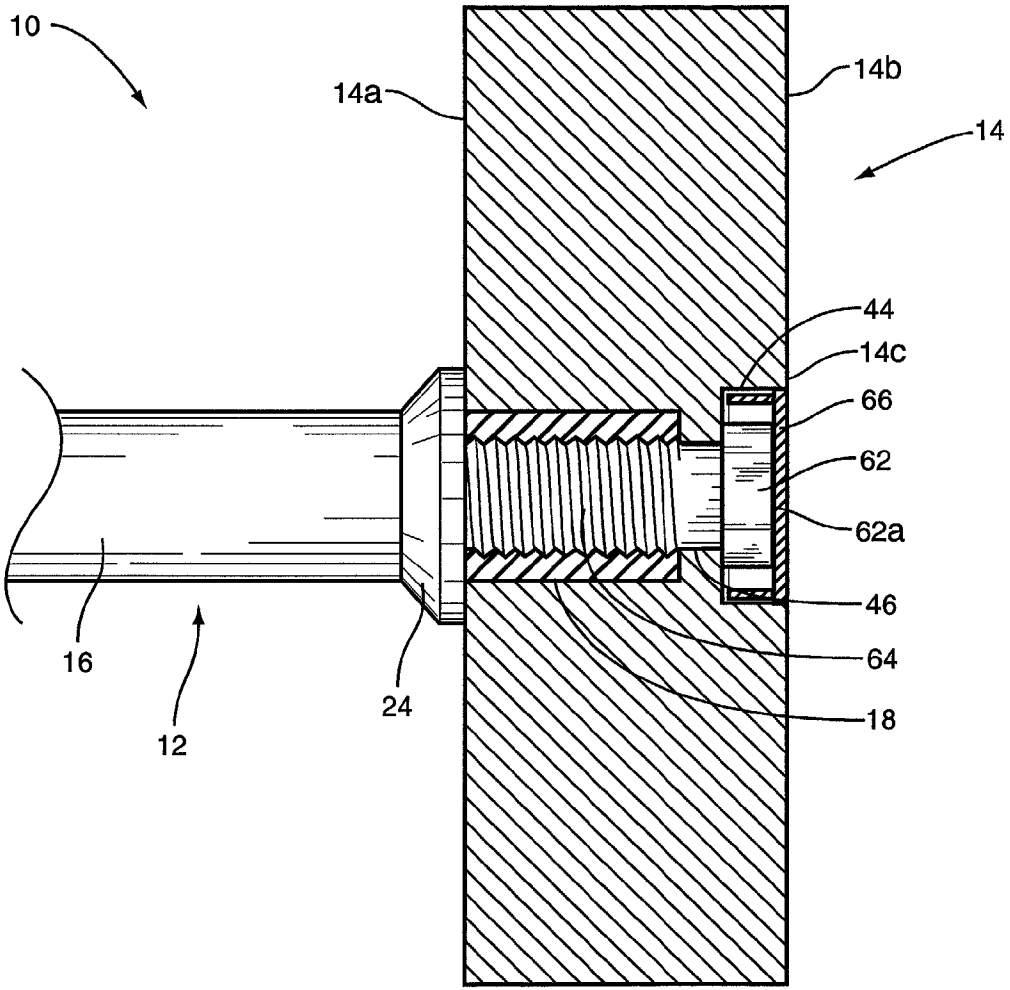
FIG. 2 is a view of one end portion of the weight lifting device, again with portions shown in section, wherein the weight plate is secured to the bar or handle.

It is appreciated that when the bolt 60 has been secured in place, that the bolt head, as shown in FIG. 2, will be completely recessed within the weight plate 14. More particularly, the bolt head 62 will lie within the confines of the recessed area 44 and will not project outwardly past the plane of the outer side 14*b* of the weight plate 14.

Further, for cosmetic reasons, and to prevent human body parts from coming into contact with the bolt head 62, a cap 66 is provided. Cap 66 can be inserted into and over the opening 40 about the outer side 14*b* of the weight plate 14. Alternatively, the cap 66 can be designed to simply snap into the opening adjacent the outer side 14*b* of the weight plate 14. This effectively conceals the bolt 60 and prevents the bolt from coming into contact with a person using the weight lifting device 10 or even a person standing near or assisting a person using the weight lifting device.

Figure 3:
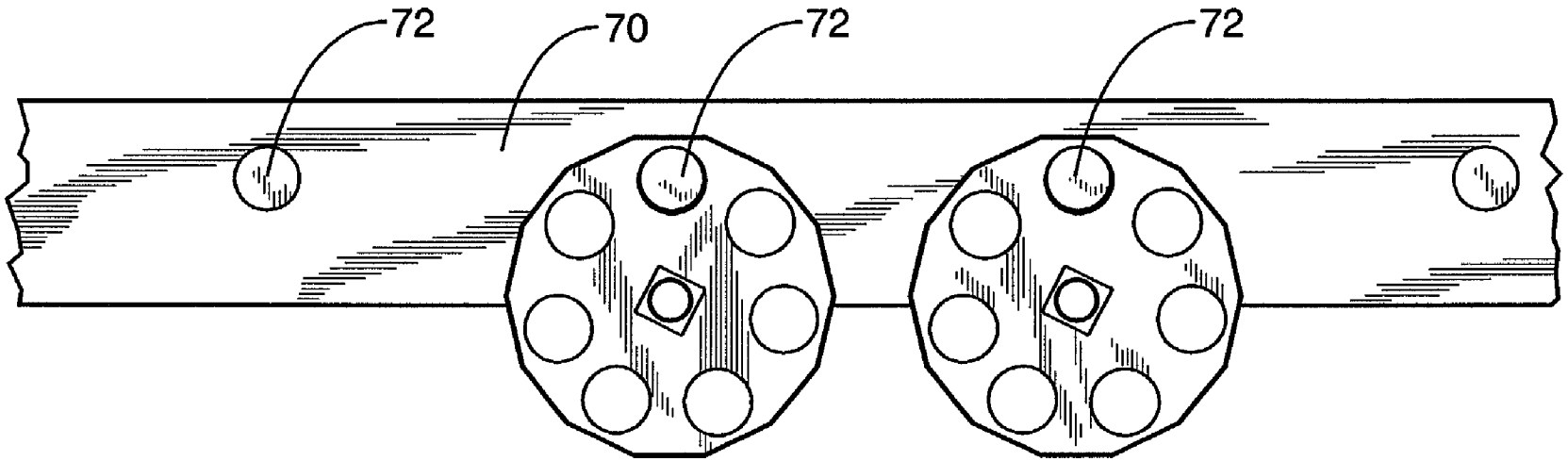
FIG. 3 illustrates a support structure for supporting one or more weight plates.

Shown in FIG. 3 is one embodiment of the weight plate 14. In this embodiment, the weight plate 14 includes a series of openings formed around the periphery of the weight plate. Further, there is provided a support structure for supporting one or more weight plates. In this case, there is provided a horizontal support 70 having a series of spaced apart pegs or hanging arms 72 that are utilized to project through one of these periphery openings formed in the weight plate 14 so as to support the same.

As a general rule, the handle or bar 12 would be of a generally constant length between the inside collars 24. However, the thickness and size of weight plates will vary. Accordingly, the length of the end portion 18 extending outwardly from the inside collar 24 can vary to accommodate certain size weight plates and particularly match the depth of the receiving area 42 formed in the central opening 40 of the weight plate 14.

It is contemplated that the outer rim or the outer periphery of the weight plate 14 can be multi-sided. This will prevent the weight plate 14 from rolling or moving easily when the weight lifting device is placed on the floor or other support area. It is contemplated that a 14 sided outer rim for the weight plate would be desirable. However, it is appreciated that the number of sides formed on the outer periphery could vary from one application or from one design to another.

It is contemplated that the plates will be made up of many different sizes allowing for a wide range of incremental weight increases. For example, it is contemplated that weight plates sizes could be in 2.5 pound increments and as such a large array of weight plates ranging from 2.5 pounds, 5.0 pounds, 7.5 pounds, 10.0 pounds, etc. could form a part of a weight lifting set.

Also, it is contemplated that the weight plate of the present invention can have from 1 to 20 periphery holes cast around the weight plate. These holes can be round, elongated, diamond-shaped, heart-shaped or any other shape for that matter. Holes also can be cast in the outer face without extending completely through the plate, so as to take less weight out of the plate. Alternatively, the weight plate may include no periphery holes.

In the case of the design illustrated herein, the polygonal shape of the end portion 18 and the receiving area 42, will prevent the weight plate 14 from freely rotating on the handle or bar 12 even if the securing mechanism just described fails for any reason. Thus, the entire securing mechanism that forms a part of the weight lifting device 10, aims at providing a secure relationship between the weight plate 14 and the handle 12 and at the same time provide a clean and smooth design that effectively conceals the entire securing mechanism and accordingly prevents one's body from coming into contact with a protruding bolt or other securing type of mechanism.

As seen in the drawings, the inner and outer sides 14*a* and 14*b* of the weight plate 14 are generally flat. Note that the outer side 14*b* includes a central area that extends around the opening or through bore 40 and adjacent the recessed area 44. For purposes of reference, this central area is referred to by 14*c*. As seen in FIG. 2, when the bolt 60 is secured within the through bore 40 in the weight plate, the central area 14*c* surrounding the recessed area 44 lies in plane that is outwardly of the face 62*a* of the bolt head or aligns with the face 62*a* of the bolt head. Thus, even with respect to the immediate area of the weight plate that surrounds the recessed area 44, it is seen that the bolt head 62 is still recessed such that it does not extend outwardly past the plane of the central area 14*c* of the outer side 14*b* of the weight plate.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A weight lifting exercise device comprising: a bar having opposed end portions; each end portion having a polygonal shape; a threaded bore formed in each end portion; a weight plate adapted to be mounted to an end portion of the bar; the weight plate including a through bore extending through the weight plate and including a first outer section that assumes a polygonal shape for receiving the polygonal shaped end portion of the bar, a second outer section that forms a bolt head recess, and an intermediate section; a bolt having a shank for connecting the weight plate to one end portion of the bar; and wherein when the weight plate is connected to one end portion of the bar, the bolt extends through the through bore of the weight plate such that a portion of the bolt is threaded within the threaded bore of the end portion of the bar which is in turn disposed inside of the polygonal shaped first outer section of the through bore of the weight plate, and wherein the bolt head is recessed within the second outer section while the shank extends from the bolt head through the intermediate section of the through bore of the weight plate.

2. The weight lifting device of claim 1 wherein the end portions of the bar and the first outer section of the through bore are rectangularly shaped with the end portion of the bar being sized to fit within the first outer section of the through bore.

3. The weight lifting device of claim 1 wherein the end portions of the bar and the first outer section of the through bore assume a generally square shape and wherein the end portions of the bar are sized such that the end portions may fit within the outer section of the weight plate.

4. The weight lifting device of claim 1 including a plate adapted to be secured to the weight plate adjacent the second section of the through bore such that the plate covers the head of the bolt when the head is recessed within the through bore.

5. The weight lifting device of claim 1 wherein the cross-sectional area of the intermediate section is less than the cross-sectional area of either the first or second section.

6. The weight lifting device of claim 1 wherein the second outer section of the through bore is of a circular cross-sectional area.

7. The weight lifting device of claim 1 including a support rack for supporting one or more weight plates, the support rack including a support and a hanging arm extending outwardly from the support; and wherein the weight plate includes at least one opening for being engaged by the hanging arm so as to support the weight plate.

8. The weight lifting device of claim 1 including a collar formed on the bar inwardly of the end portion of the bar, such that when the bar is secured to the weight plate, the collar lies adjacent a portion of the weight plate.

9. The weight lifting device of claim 1 wherein the weight plate includes a pair of generally flat sides with each side extending from the through bore outwardly therefrom.

10. The weight lifting device of claim 9 wherein the weight plate includes an outer periphery and wherein each side extends generally flat from the outer periphery inwardly to the through bore; and wherein when the bolt head assumes a recessed position within the through bore, the entire bolt head lies either flush or inwardly of the sides of the weight plate.

11. The weight lifting device of claim 1 wherein the weight plate includes an inner side and outer side and wherein when the weight plate is secured to the handle and the bolt head is recessed within the through bore, the entire outer side of the weight plate is disposed outwardly of the bolt head.

12. The weight lifting device of claim 1 wherein the weight plate includes inner and outer sides and wherein the outer side includes a central area that surrounds the through bore and wherein when the weight plate is secured to the handle, the head of the bolt is recessed such that the head of the bolt lies inwardly of the central area of the outer side.

13. A weight lifting apparatus comprising:

a handle having at least one end portion;

a threaded bore formed in the end portion;

a weight plate having opposed sides and an opening extending through the weight plate and extending from one side of the weight plate to the other side;

a bolt for securing the weight plate to the end portion of the handle, the bolt including a head and a shank with at least a portion of the shank being threaded;

the opening within the weight plate having a receiving area for receiving the end portion of the handle, a recessed area for receiving the bolt head, and a shoulder disposed between the receiving area and the recessed area; and wherein when the weight plate is connected to the end portion, the bolt head is recessed within the recessed area and the shank extends from the head past the shoulder into the threaded bore of the end portion.

14. The weight lifting device of claim 13 wherein when the weight plate is connect to the end portion, the head of the bolt contacts the shoulder.

15. The weight lifting device of claim 14 wherein the end portion includes a terminal end that contacts the shoulder when the weight plate is secured to the end portion.

16. The weight lifting device of claim 13 wherein the cross-sectional area of the opening in the area of the shoulder is less than the cross-sectional area of either the receiving area or the recessed area.

17. The weight lifting device of claim 13 wherein the receiving area includes an interior surface having a plurality of walls.

18. The weight lifting device of claim 17 wherein the recessed area includes an interior surface having a curved wall.

19. The weight lifting device of claim 18 wherein the interior surface of the recessed area is cylindrical.

20. The weight lifting device of claim 13 wherein the receiving area includes a polygonal interior surface and the recessed area includes a curved interior surface.

21. The weight lifting device of claim 20 wherein the shoulder effectively divides the receiving area and recessed area but wherein the opening extends past the shoulder such that the shank of the bolt may extend past the shoulder into the threaded bore of the end portion of the handle.

22. The weight lifting device of claim 20 wherein the cross-sectional area of the receiving area is generally square or rectangular while the cross-sectional area of the recessed area is generally curved.

23. The weight lifting device of claim 13 including a support for receiving and holding at least one weight plate, the support including a hanging arm and wherein the weight plate includes at least one support opening adapted to be inserted over the handing arm such that the hanging arm supports the weight plate.

24. The weight lifting device of claim 13 including a collar secured to the handle inwardly of the end portion such that the collar effectively limits the length of the end portion that may be inserted into the opening within the weight plate.

25. The weight lifting apparatus of claim 13 wherein the opposed sides of the weight plate include an outer side having a central area that surrounds the opening and wherein when the bolt head is recessed within the recessed area, the plane of the central area of the outer side aligns with the face of the bolt head or is disposed outwardly thereof.

26. A method of connecting a handle of a weight lifting device to a weight plate having an inner side and outer side, comprising: extending an end portion of the handle into one end of an opening extending through the weight plate; extending a bolt into the other end of the opening of the weight plate; threading the bolt into a threaded bore formed in the end portion of the handle and securing the end portion of the handle within the opening of the weight plate; turning the bolt in the threaded bore sufficiently to recess a head portion of the bolt within the weight plate itself such that the head portion of the bolt does not project past the adjacent side of the weight plate.

27. The method of claim 26 including limiting the movement of the head of the bolt within the opening by engaging the head of the bolt with a shoulder that generally separates the head of the bolt from the end portion of the handle disposed within the opening.

28. The method of claim 27 including capping the opening adjacent the head portion of the bolt so as to generally conceal the bolt within the opening of the weight plate.

* * * * *